United States Patent [19]

Kutz

[11] 4,070,875

[45] Jan. 31, 1978

[54] APPARATUS FOR TREATING OF SYNTHETIC TEXTILE WEBS

[75] Inventor: Johannes Kutz, St. Tonis near Krefeld, Germany

[73] Assignee: Eduard Kusters, Krefeld, Germany

[21] Appl. No.: 730,159

[22] Filed: Oct. 7, 1976

Related U.S. Application Data

[63] Continuation of Ser. No. 440,026, Feb. 6, 1974, abandoned.

[30] Foreign Application Priority Data

Feb. 7, 1973 Germany ..... 2305932

[51] Int. Cl.[2] ..... D06B 3/22

[52] U.S. Cl. ..... 68/3 SS; 26/2 R; 68/20; 68/175

[58] Field of Search ..... 26/2 R; 28/72 P, 74 P, 28/76 P; 68/3 SS, 13 R, 15, 20, 175, 181 R; 8/151

[56] References Cited

U.S. PATENT DOCUMENTS

| | | | |
|---|---|---|---|
| 2,071,922 | 2/1937 | Drobile et al. | 8/151 X |
| 3,719,062 | 3/1973 | Fleissner | 28/74 P X |
| 3,739,436 | 6/1973 | Naujoks et al. | 68/13 R X |
| 3,747,375 | 7/1973 | Gregg | 68/20 X |
| 3,750,428 | 8/1973 | Bruckner | 68/20 X |

FOREIGN PATENT DOCUMENTS

| | | | |
|---|---|---|---|
| 2,026,974 | 9/1970 | France | 68/181 R |
| 1,235,503 | 6/1971 | United Kingdom | 28/76 P |

*Primary Examiner*—Philip R. Coe

*Attorney, Agent, or Firm*—Kenyon & Kenyon, Reilly, Carr & Chapin

[57] ABSTRACT

An apparatus and process are described herein for positioning the pile threads found on textile webs manufactured from synthetic fibers which become pliable upon exposure to heat. Means are provided for first routing the textile web through heating means which generally would be a hot water bath. The pile threads are softened by the heat of the hot water bath and become sufficiently pliable as to enable them to assume any position. Because of their buoyancy in water the pile threads tend to orientate themselves perpendicular to the web backing. In order to maintain the pile threads perpendicular until given a chance to cool, the web is removed from the heating apparatus in substantially a horizontal plane. Suction means are provided to cool the textile web as it leaves the heating portion of the apparatus thereby speeding up the set time of the piles. The suction means can also be used to remove a substantial portion of the hot water saturating the textile web. The water can be returned to the hot water bath for reuse.

9 Claims, 2 Drawing Figures

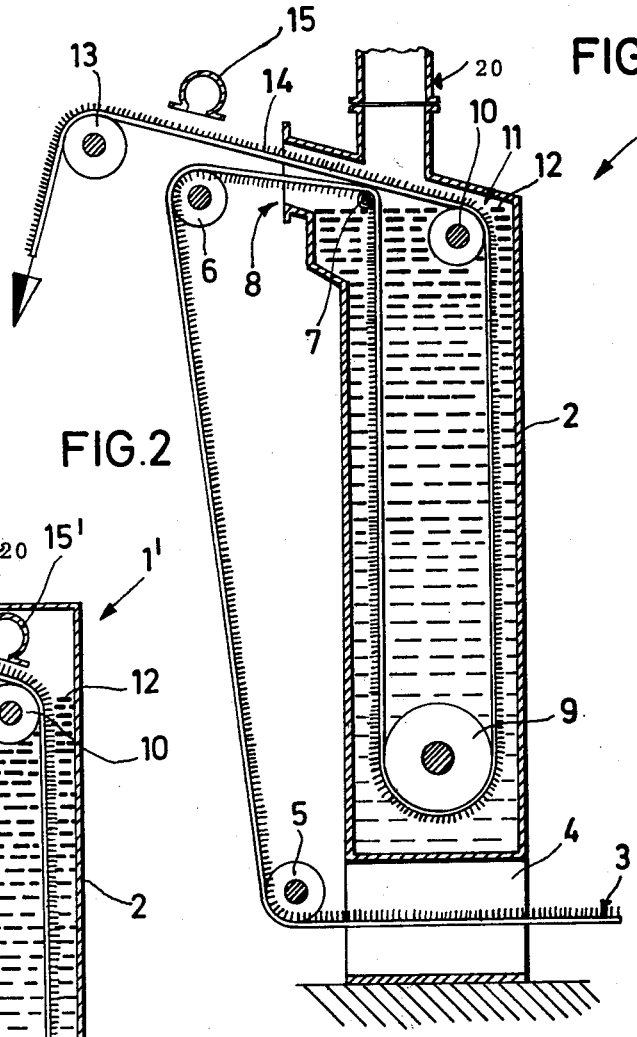
FIG.1
FIG.2
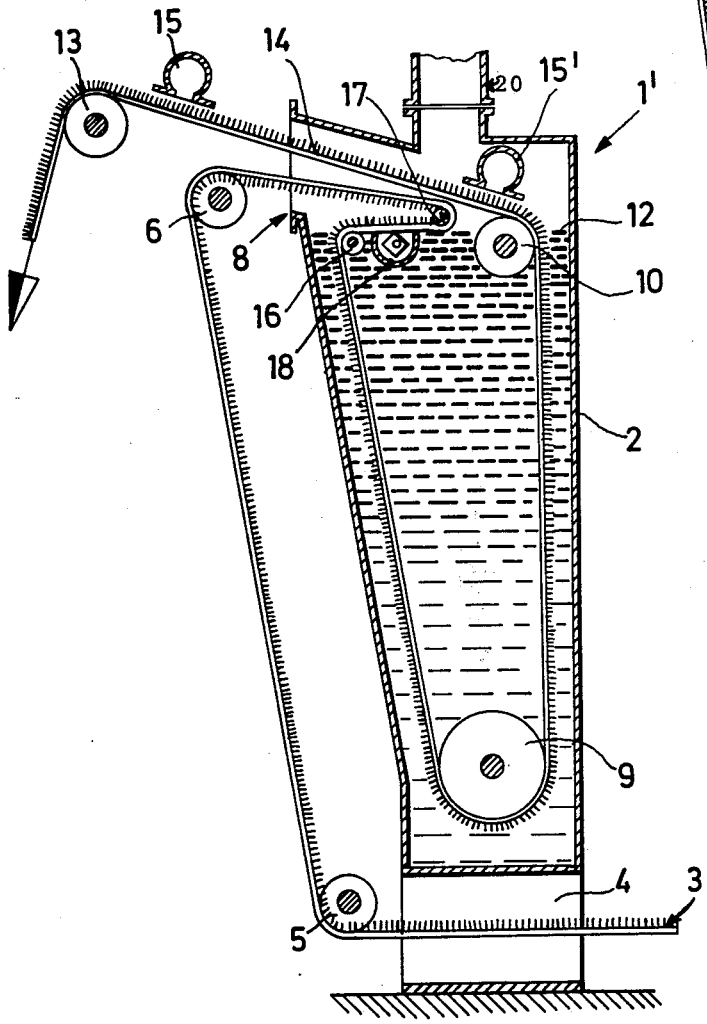

APPARATUS FOR TREATING OF SYNTHETIC TEXTILE WEBS

This is a continuaton of application Ser. No. 440,026 filed Feb. 6, 1974, and now abandoned.

BACKGROUND OF THE INVENTION

1. Field of the Invention

This invention pertains generally to carpet pile positioning means and in particular to means for positioning synthetic piles.

2. Background of the Invention

Textile webs comprised of synthetic pile threads, particularly those manufactured from various thermoplastic and other heat sensitive fibers, oftentimes present an unattractive appearance. This is because the piles have taking a non-uniform set across the surface of the carpet. This effect is particularly noticeable with the longer piled carpets. The unattractiveness is further emphasized by the dyeing of the carpets resulting in an uneven cratered appearance. It is therefore an object of this invention to provide a process and means for positioning the piles of a synthetic carpet in a substantially vertical position, ensuring an evenness across the surface thereof and thereby enhancing the appearance of said carpet.

SUMMARY OF THE INVENTION

This invention provides a means for routing the textile web of synthetic, heat sensitive piles, into a vessel containing a hot liquid medium which preferably is a hot water bath. The web is maintained in the hot water bath for a period of time sufficient to enable the piles to become adequately pliant. Their buoyancy while in the liquid medium and the effect of the neighboring piles causes the piles to assume a position substantially perpendicular to the web backing. The rollers for routing the carpet through the bath interface with the textile web on the back side thereof so as not to crush the pile as it passes through the bath. The carpet with softened piles passes across a roller positioned at the point of exit from the hot water bath. This roller changes the direction of the web so that it exists from the hot water bath in substantially a horizontal plane. The piles at this point are extending in a substantially vertical position. The web is maintained in this horizontal position for a sufficient period of time to enable the synthetic piles to take a set. The piles maintain their vertical orientation since the forces of gravity are minimal in this position.

In order to speed up the cooling of the heated piles, thereby enabling a quickening of the set time for such piles, a suction means is employed in close proximity to the point at which the web exits from the hot water bath. The suction means draws "cool" room temperature air across the pile with the further effect of insuring that the piles maintain a substantially vertical orientation while they cool.

Where the pile of a particular textile web is relatively dense such that a substantial amount of hot water is retained by said piles, additional suction means are provided in very close proximity to the point of exit from the hot water bath. These suction means extract from the carpet a large amount of the hot water retained. The extracted water is returned to the bath thereby minimizing the amount of energy required to maintain the hot water bath at a suitable operating temperature. The apparatus can be adapted to include a vibration or beater roller which agitates the web prior to its submersion in the hot water bath. This loosens the piles and improves the results obtained.

BRIEF DESCRIPTION OF THE DRAWINGS

Reference is now made to the accompanying drawings for a better understanding of the nature and objects of the invention. The drawings illustrate the best mode presently contemplated for carrying out the objects of the invention and its principles, and are not to be construed as restrictions or limitations on its scope.

FIG. 1 shows in a schematic form a vertical section of one embodiment of the subject invention.

FIG. 2 shows in schematic form a vertical section of a second embodiment of the present invention.

DESCRIPTION OF THE PREFERRED EMBODIMENT

Many of the elements in the embodiments of FIGS. 1 and 2 are common and will be identified by identical reference numerals in the subsequent discussion.

Referring particularly to FIG. 1, an apparatus in accordance with the principles of this invention is identified generally by the numeral 1. The apparatus includes a vessel 2, approximately 2 to 4 meters in height, which is filled substantially to the top thereof by a suitable liquid medium, which in the preferred embodiment is water. The water is heated by means not shown to a temperature in the range between 90° and 95° C. The vessel is substantially enclosed with the exception of the duct 20 for supplying the heated water and the web entrance and exit opening, 8. The fact that the vessel is enclosed helps to retard the dissipation of the heat from the water, thus minimizing the amount of energy necessary to maintain the water at the proper operating temperature.

Positioned below the vessel 2 is a passageway 4, through which the textile web 3 comprised of a backing and heat sensitive pile threads 14, is routed prior to passage through apparatus 1. The web is preferably in a horizontal position with the pile side up as shown. Guide rollers 5 and 6 alter the direction of flow of the web material directing it into the entrance portion of opening 8. An additional roller 7, positioned just inside of the entrance opening, directs the web, in a downward direction, into the liquid medium.

The web is next directed by guide roller 9 positioned at the bottom of the vessel. The guide roller 9, as shown, changes the direction the web travels by approximately 180°. The web then returns the full length of the vessel to the top thereof at which point it engages still another guide roller 10. This roller, for reasons soon to become evident, is only partially submerged in the hot liquid medium. The web is routed across still another guide roller, 13 by which the textile web is directed for additional processing. The web is powered over the various guide rollers just described by suitable means, not shown but well known to those skilled in the art.

The orientation of the textile web 3 as it travels through the vessel 2, and in particular through the hot liquid medium, is such that guide rollers 9 and 10 contact the backside of the textile web and not the side where the pile threads 14 are found. The physical relationship between the roller 10, roller 13 and the exit portion of the opening 8, are such that the web at the point of exiting from the hot liquid medium, is in a substantially horizontal plane with the pile side up.

Positioned as close to the exit portion of opening 8 is a suction means schematically represented by numeral 15. The suction means 15 extend the width of web 3 and is located preferably on the back side of the web.

In operation, the web 3 of synthetic, heat sensitive piles is routed to the vessel 2 by means of rollers 5 and 6. The carpet passes through the entrance portion of opening 8 and is then directed down into the vessel of hot water by roller 7. Upon entering the hot liquid medium within the vessel 2, the previously rigid piles are softened by their exposure to the elevated temperature of the liquid medium. Because of their buoyancy within the liquid medium the effects of gravity are negated. The piles tend to orient themselves uniformly in a vertical position relative to the web backing. The period of time that the web or a given portion of the web is submerged below the level 12 of the liquid medium must be long enough, of course, to result in the pile threads becoming sufficiently pliable such that they're able to achieve the desired effect. This time period can be controlled by the height of the fluid in the vessel and the speed with which the web travels through said vessel. The rollers 9 and 10, which contact the textile web while it is submerged in the hot liquid medium must do so from the backing side of the web. This prevents any crushing of the pile while the web is submerged.

Because the pile threads will begin to assume the position or orientation that they have when they are first exposed to a cooler environment, it is necessary for the purposes of this invention that upon exiting from the hot liquid medium that the web be maintained in a substantially horizontal plane with the piles extending vertically upward from the backing. In this way, the gravitational effect on the pile threads 14 which would cause the piles to bend at their juncture with the web backing is minimized. It is important that the web be maintained in this horizontal position, for as long as it takes for the piles to achieve the intended set.

To speed up this time-to-set, the suction means, 15 is positioned as close as the exit portion of opening 8 as is practically possible. The suction means 15 draws room temperature air through the web and past the pile threads thereby hastening the cooling process. Additionally, suction means 15 has sufficient power to draw off a substantial portion of the heated liquid which has been retained by the piles of the web. Although somewhat below the temperature of the liquid in the vessel 2, this liquid is recovered and reintroduced into the vessel 2, through duct 20. Because of its elevated temperature, the recycled liquid minimizes the amount of additional energy necessary to be added to the system to maintain the temperature of the liquid in the vessel in the desired operating range. Further, the suction means 15 helps to maintain the pile threads in a position substantially perpendicular to the web backing as they cool down.

As noted earlier, FIG. 2 is similar to a large degree to the embodiment described in FIG. 1. In addition to the elements already identified with FIG. 1, the embodiment of FIG. 2 includes a pair of guide rollers 16 and 17 which take the place of roller 7 of FIG. 1. An additional beater roller 18 is interposed in the path the web takes, between the rollers 16 and 17. This beater roller is preferably square shaped and its purpose is to impart a force perpendicular to the direction of travel of the web past the beater roller which results in a substantial vibration of the carpet prior to its entry in the liquid. This has a loosening effect on the pile threads. The vessel 2, accordingly, is expanded at the top of the vessel to accommodate the additional rollers just described.

The web after beating, is again processed through the hot liquid medium in the vessel 2 and exits from the liquid mdium in a substantially horizontal plane so that the piles are oriented in a vertical position. An additional suction device, 15', is positioned just above the pile at roller 10, close to the point of exit of the web from the liquid. Suction means 15' are similar to previously described suction means 15. Its particular purpose is to remove from the pile much of the hot liquid retained by the pile threads. Because of its location within the vessel 2, the suction means 15' has a minimal effect in attempting to cool the pile. The additional suction means 15 is positioned outside of the vessel close to the exit portion of the opening 8. It is shown in this embodiment as being positioned above the pile. It has been found that this is a suitable location provided a reduced vacuum is employed compared to the embodiment of FIG. 1.

Much of the water which is retained by the web upon exiting from the liquid in the vessel is withdrawn by suction means 15'. Because its temperature is substantially close to the temperature of the liquid medium remaining in the vessel 2, the embodiment of FIG. 2 results in a substantially less amount of energy being required to maintain the vessel liquid in the desired operating range.

It is to be appreciated that changes in the above embodiments can be made without departing from the scope of the present invention. For instance, although means 15 have been described as a suction device, it is readily apparent that the cooling effect achieved by 15, and to some extent the removal of the liquid medium, can be effected by a suitably positioned air jet which forces air through the web backing and pile threads, transverse to the web. Other variations of the specific construction disclosed above can be made by those skilled in the art without departing from the invention defined in the appended claims.

What is claimed is:

1. In an arrangement for treating a textile web having a pile in which the web is required to enter and leave a treatment station with its pile facing upward, an apparatus for positioning the pile threads of a textile web fabricated from heat sensitive, synthetic material, which is comprised of:

a. means in the form of a substantially vertical tank having a top and a bottom and spaced sides extending substantially vertically betwen said top and bottom for storing a heated liquid of predetermined temperature, said means having an inlet and outlet opening in one of said spaced sides near the top of said means;

b. means to guide the textile web into said means for storing and from said means for storing through said opening such that the textile web enters said means for storing below the point at which the textile web exits said means for storing, for storing said means filled with said heated liquid to a level closely adjacent the point where the textile web enters said means for storing;

c. a passageway of width at least equal to the width of the textile web under said means for storing;

d. means for routing said textile web through said passageway beneath said means for storing from the one of said sides opposite said opening and upward to said opening and into said heated liquid;

e. means for guiding said textile web through said heating liquid, first vertically downward and then vertically upward, for a predetermined period of time, said guide means contacting only the back side of said web, and said web being contacted by no other structure while within said heated liquid;

f. means disposed approximately at the top of said heated liquid and within said means for storing for changing the direction of said web from vertical to substantially horizontal thereby bringing said web to a substantially horizontal position immediately after removal from said heated liquid; and g. means for maintaining said web after removal from said heated liquid substantially horizontal for a second period of time, said means for maintaining in cooperation with said means for changing also directing said web out of said means for storing through said opening in said means for storing.

2. The apparatus of claim 1 further comprising means for forced cooling said web after removal from said for storing means.

3. The apparatus of claim 2 wherein said means for forced cooling includes means for recovering a substantial portion of the heated liquid which is retained by said web.

4. The apparatus of claim 3 further comprising means for returning the recovered heated liquid to said means for storing.

5. The apparatus of claim 3 and further comprising additional means, positioned within said means for storing, adjacent said pile, immediately after the point where said web has been directed from a vertical to a substantially horizontal position for recovering a portion of the heated liquid retained by said web prior to said recovery of heated liquid by said means for forced cooling.

6. The apparatus of claim 5 further comprising means, for returning the recovered heated liquid to said means for storing.

7. The apparatus of claim 6 further comprising means for agitating said heated web before said web is routed into said liquid.

8. The apparatus of claim 2 wherein said means for forced cooling is comprised of a suction device positioned vertically above said web, said suction device spanning the width of said web.

9. The apparatus of claim 1 further comprising means for agitating said web before said web is routed into said heated liquid.

* * * * *

UNITED STATES PATENT AND TRADEMARK OFFICE

CERTIFICATE OF CORRECTION

PATENT NO. : 4 070 875

DATED : January 31, 1978

INVENTOR(S) : JOHANNES KUTZ

It is certified that error appears in the above-identified patent and that said Letters Patent are hereby corrected as shown below:

Column 1, line 5: change "continuaton" to --continuation--;

Column 1, line 44: change "exists" to --exits--;

Column 3, line 41: change "as" (second occurrance) to --to--;

Column 4, line 5: change "mdium" to --medium--;

Column 4, line 50 (claim 1): change "betwen" to --between--;

Column 4, lines 59-60 (claim 1): change "for storing said means" to --said means for storing--;

Column 5, line 2 (claim 1): change "heating" to --heated--;

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*